US012188317B2

(12) United States Patent
Borschneck et al.

(10) Patent No.: US 12,188,317 B2
(45) Date of Patent: Jan. 7, 2025

(54) METHOD AND APPARATUS FOR COLLECTING DOWNHOLE DEBRIS

(71) Applicant: TORSCH INC., Calgary (CA)

(72) Inventors: Sean Borschneck, Calgary (CA); Abhinandan Tripathi, Sugar Land, TX (US); Sanjay Menon, Calgary (CA); Bradley Cridland, Calgary (CA)

( * ) Notice: Subject to any disclaimer, the term of this patent is extended or adjusted under 35 U.S.C. 154(b) by 0 days.

(21) Appl. No.: 18/176,912

(22) Filed: Mar. 1, 2023

(65) Prior Publication Data

US 2024/0018847 A1 Jan. 18, 2024

Related U.S. Application Data

(60) Provisional application No. 63/388,934, filed on Jul. 13, 2022.

(51) Int. Cl.
*E21B 27/00* (2006.01)

(52) U.S. Cl.
CPC ..... *E21B 27/005* (2013.01); *E21B 27/00* (2013.01)

(58) Field of Classification Search
CPC ..... E21B 27/00; E21B 27/005; E21B 31/06; E21B 31/08; E21B 37/02
See application file for complete search history.

(56) References Cited

U.S. PATENT DOCUMENTS 1,113,787 A * 10/1914 Jay ..... E21B 27/00 294/68.25
2,280,054 A * 4/1942 Beck ..... E21B 43/088 166/171
2,698,024 A * 12/1954 Canalizo ..... E21B 43/123 417/112
3,937,281 A * 2/1976 Harnsberger ..... E21B 43/088 210/497.1
5,553,669 A * 9/1996 Trainer ..... B01D 29/48 166/105.1
2017/0328190 A1* 11/2017 Fielder, III ..... E21B 34/08

* cited by examiner

*Primary Examiner* — Brad Harcourt

(57) ABSTRACT

Disclosed is an apparatus and method for collecting downhole debris wherein the apparatus comprises a tubular member extending between first and second ends connectable to a production string connectable in fluidic communication with the production string and having an open flow path therethrough between the first and second ends, at least one coiled member extending between first and second ends, said second end being operably connected to the tubular member and a top cap secured to the first end of the coiled member and adapted to sealably close a top end of the coiled member. The method comprises extending the coiled member in response to an upward flow through the tubular member so as to permit upward flow of fluids and solid particles and compressing the coiled member in response to a downward flow so as to permit fluid flow between coils of the coiled member while retaining solid particles thereover.

16 Claims, 3 Drawing Sheets

METHOD AND APPARATUS FOR COLLECTING DOWNHOLE DEBRIS

CROSS-REFERENCE TO RELATED APPLICATION

This application claims benefit of U.S. Provisional Patent Application No. 63/388,934 filed Jul. 13, 2022 entitled METHOD AND APPARATUS FOR COLLECTING DOWNHOLE DEBRIS.

BACKGROUND

1. Technical Field

This disclosure relates generally to petroleum production and in particular to method and apparatus for collecting and removing debris in a downhole wellbore.

2. Description of Related Art

In many down hole processes, debris including rock particles, sand or machined-out tool components may be produced within the well bore or casing. Frequently, such debris is undesirable but difficult to remove from the wellbore or tool string without time consuming cycling of the wellbore to remove the debris through filtering at the surface. In particular, such debris may frequently be undesirable at one or more tools at the bottom of a tool string due to concerns of fouling or damaging such tools.

Current methods of collecting and containing debris within a wellbore have not been entirely satisfactory. In particular, some systems have utilized a debris collector having separate downwardly and upwardly flowing fluid paths so as to direct the downward flowing fluid through a filter element for collection while permitting the upward flowing fluid to bypass the filter element. However, it will be appreciated that due to duplication of flow paths, such devices may be required to be large so as to provide adequate space for such duplicate flow paths. Examples of such designs may be found in U.S. Pat. No. 10,584,571 to Leitch.

SUMMARY OF THE DISCLOSURE

According to a first embodiment, there is disclosed an apparatus for collecting downhole debris comprising a tubular member extending between first and second ends connectable to a downhole production string connectable in fluidic communication with the production string and having an open flow path therethrough between the first and second ends, at least one coiled member extending between first and second ends, said second end being operably connected to the tubular member and a closed end proximate to the first end of the at least one coiled member and adapted to sealably close a top end of the at least one coiled member.

The apparatus may further include first and second end connectors at each end of the tubular member. The apparatus may further comprise a spacing inner tube extending between the second end connector and the second end of the at least one coiled member so as to form an annulus between the inner tube and tubular member. The inner tube may have a length selected to contain a desired quantity of a debris between the inner tube and the tubular member.

The at least one coiled member may be biased to a compressed configuration with adjacent coils touching each other at an initial position. The at least one coiled member may comprise a spring. The spring may have a spring rate selected to be expanded by a pressure differential acting on the top closure in response to an upward flow at a predetermined flow rate.

The top closure may comprise a top cap. The top cap may extend between top and bottom surfaces. The bottom surface may include an annular groove therearound for receiving the first end of the at least one coiled member therein. The top surface may be substantially conical. The top cap may be annularly spaced apart form an interior surface of the tubular member by a distance corresponding to the distance between the inner tube and the tubular member.

The apparatus may further comprise locating the apparatus within vertical orientations of a wellbore. The apparatus may further comprise locating the apparatus within deviated orientations of a wellbore. The apparatus may further comprise locating the apparatus within horizontal orientations of a wellbore.

According to a further embodiment, there is disclosed a method for collecting downhole debris comprising locating a tubular member extending between first and second ends at a location within a downhole production string, extending at least one coiled member within the tubular member in response to an upward flow through the tubular member so as to permit upward flow of fluids and solid particles and compressing the at least one coiled member in response to a downward flow so as to permit fluid flow between coils of the coiled member while retaining solid particles thereover or so as to collect debris dropping down the production string under now fluid flow therethrough.

Other aspects and features of the present disclosure will become apparent to those ordinarily skilled in the art upon review of the following description of specific embodiments in conjunction with the accompanying figures.

BRIEF DESCRIPTION OF THE DRAWINGS

The accompanying drawings constitute part of the disclosure. Each drawing illustrates exemplary aspects wherein similar characters of reference denote corresponding parts in each view.

DETAILED DESCRIPTION

Figure 1:
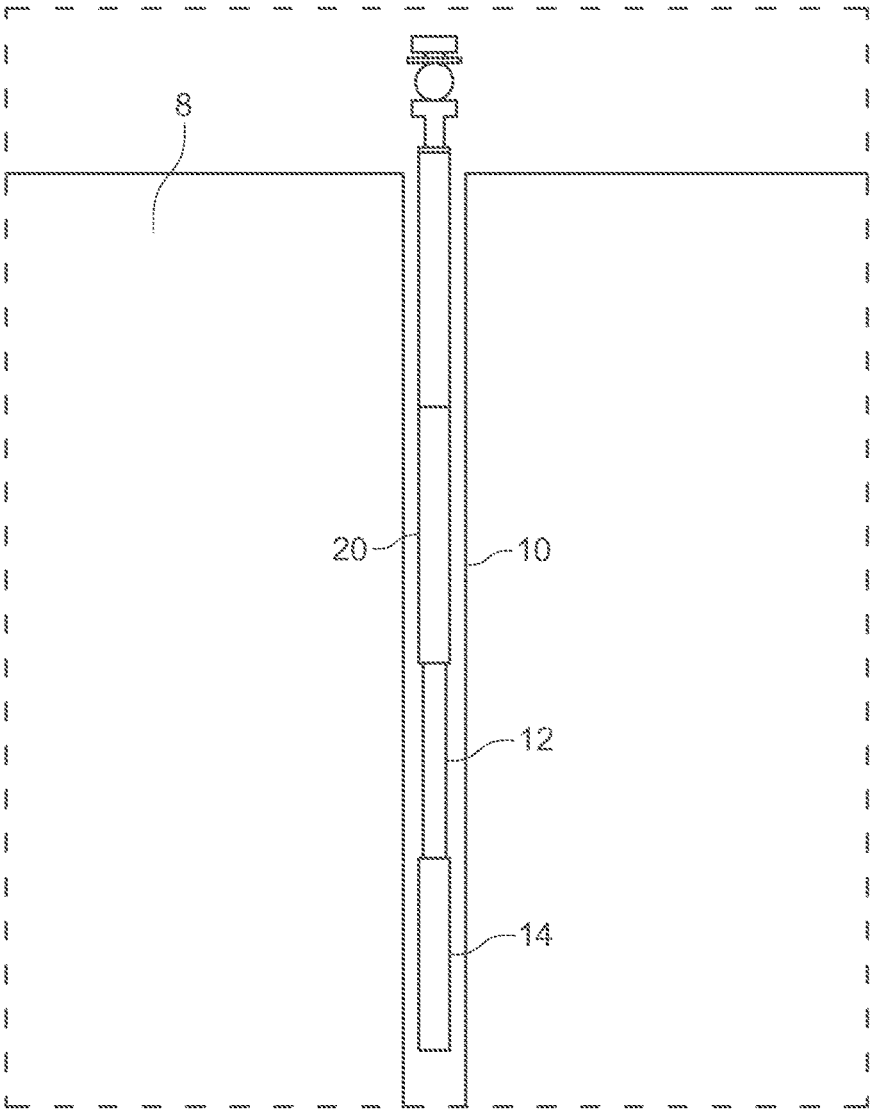
FIG. 1 is a cross-sectional view of a wellbore having a string having an apparatus for collecting debris therein.
Figure 2:
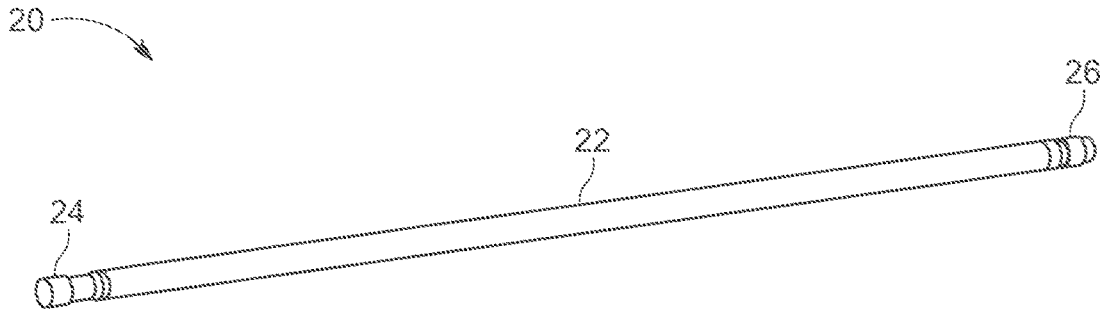
FIG. 2 is a perspective view of the apparatus for collecting downhole debris according to a first embodiment of the present disclosure.

Aspects of the present disclosure are now described with reference to exemplary apparatuses, methods and systems. Referring to FIG. 1, a wellbore 10 is drilled into the ground 8 to a production zone 6 by known methods. As illustrated in FIG. 1, the wellbore includes a casing 12, a production string, or other tubular extension thereinto as are commonly known. The string may include an apparatus 20 for collecting and retaining debris therein so as to prevent such debris from reaching one or more tools 14 at a bottom end thereof.

Although the apparatus 20 is illustrated as being located within a horizontal section of the wellbore, it will be appreciated that it may be located within any section of the well including, without limitation, vertical, deviated or horizontal. The apparatus 20 comprises an outer tubular member 22 having a longitudinally extendable, coiled member 40, such as by way of non-limiting example, a spring therein with a top cap 50 at a top end thereof. The coiled member 40 is compressed in a natural state as well as in a downward flow of fluids therethrough so as to permit the flow of fluids between the coils thereof while obstructing the flow of particles. The coiled member 40 is furthermore operable to be longitudinally lengthened in response to an upward flow of fluid through the casing so as to permit particles to pass through.

The outer tubular member 22 extends between first and second ends, 24 and 26, respectively, and includes an inner surface 28 defining a central bore 30 therethrough extending along an axis 32. As illustrated, the tubular member 22 may include first and second end connectors 34 and 36, respectively at the corresponding first and second ends 24 and 26 of the tubular member 22. The first and second end connectors 34 and 36 may include internal and external threading 35 and 37 for connection to a production string so as to locate the apparatus inline therewith. The first and second end connectors 34 and 36 may be secured to the tubular member 22 by any known means including, without limitation, threading, fasteners, welding, adhesives or the like.

Figure 3:
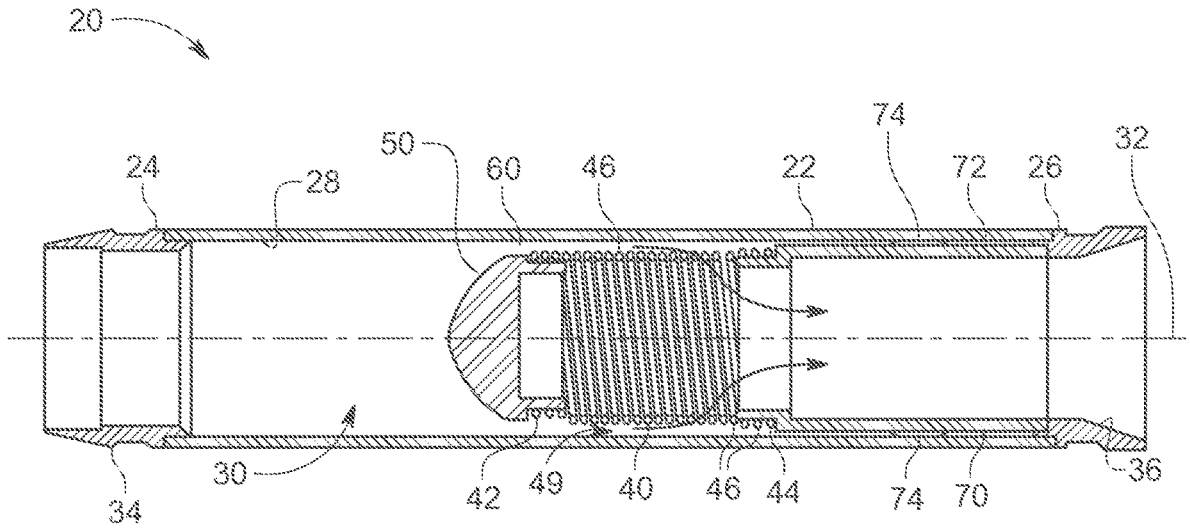
FIG. 3 is a cross sectional view of the apparatus of FIG. 1 as taken along the line 3-3 at a downwardly flowing configuration.

The coiled member 40 may, by way of non-limiting example, comprise a linear spring formed of a plurality of longitudinally aligned coils 46 extending between first and second ends, 42 and 44, respectively. The second end 44 is operably connected to the second end cap 36 so as to prevent fluid entering the apparatus from passing around the coiled member without first passing through the coiled member. The spring 40 member may be formed of a material and thickness so as to provide the desired spring constant as will be more fully set out below. The spring 40 is provided in a compressed state as illustrated in FIG. 3 with the coils 46 touching or abutting each other. In such a configuration, fluid will be able to pass between the coils, however particles larger than the spacing between the coils will be prevented from passing therethrough. In operation, it has been found that controlling the relaxed gap spacing or openings between coils due to surface imperfections in the range of 0.002 to 0.020 inches (0.05 to 0.5 mm) has been useful although it will be appreciated that other distances may be useful as well. The coiled member 40 is formed into a closed shape, such as by way of non-limiting example coiled or tubular having an outer diameter less than the diameter of the inner surface 28 of the outer tubular member 22. In such a manner, the coiled member 40 may be located therein with a coiled member gap distance between the coiled member 40 and the outer tubular member 22 generally indicated at 49 of approximately 0.06 to 2 inches (1.5 to 51 mm). The coiled member gap 49 permits the collection of debris around the outside of the coiled member when fluids are flowing downwards in a direction between from the first end to the second end of the tubular member. Although a single coiled member 40 is illustrated in the attached figures, it will be appreciated that multiple coiled members may also be utilized connected end to end so as to form a continuous surface through which fluid or fluid entrained with solid particles may flow as will be described further herein.

Figure 4:
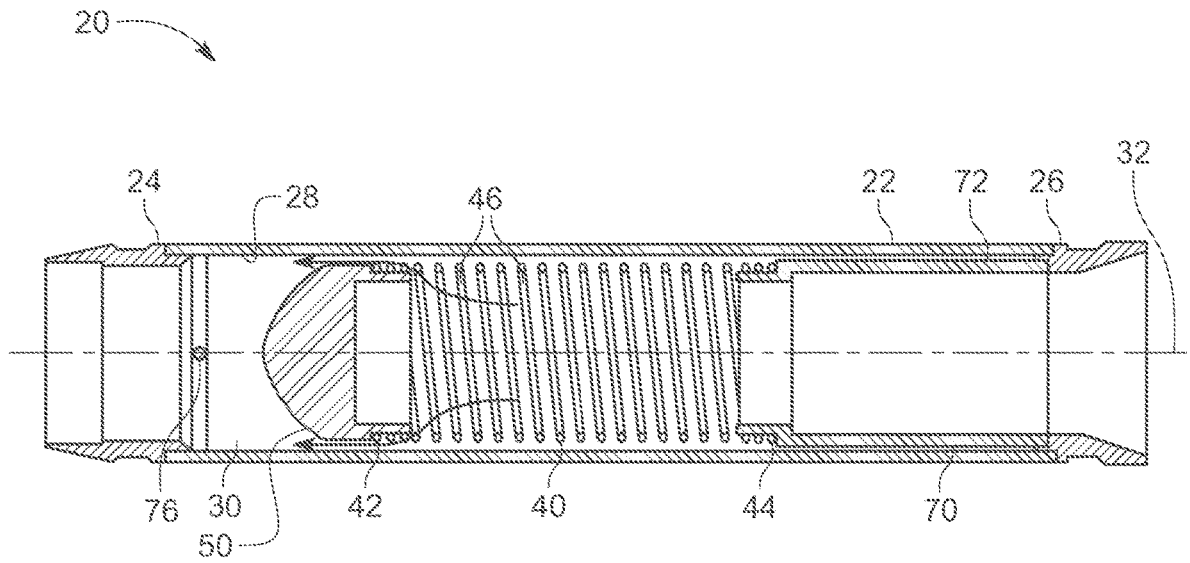
FIG. 4 is a cross sectional view of the apparatus of FIG. 1 as taken along the line 3-3 at an upwardly flowing configuration.

With reference to FIG. 4, when fluid is flowing in an upward direction from the second end 26 to the first end 24 of the tubular member, the upward fluid flow will create a pressure differential on the top cap 50 secured to the first end 42 of the coiled member so as to raise the top cap by extending the coiled member 40. It will be appreciated that the spring rate of the spring 40, when so utilized, may be selected to correspond to the desired flow rate and pressures for the desired application to ensure that the spring extends by a desired distance in response to an intended upward flow rate. As Illustrated in FIG. 4, the upward movement of the top cap 50 and extension of the coiled member 40 provides openings between the coils 46 of the coiled member so as to permit fluid a long with particles to pass therethrough. In such a manner, any particles in the bottom of the well bore may be pumped to the surface through the apparatus for collection and disposal.

Under some operating parameters and some embodiments, the coils may open to form gaps therebetween in an uneven manner. In particular, one advantage of the present structure is that in the occurrence of debris becoming packed or compressed around the coiled member 40, the upward movement of the top cap 50 and therefore the resulting opening of the coils 46 may result in the separating of the coils 46 above the debris packed region only. Accordingly any upward flow of fluid through the coils may be permitted to lift the debris from the top of the packed region only. Such selective removal of the debris from the top of the compressed region will therefor slowly clear the collected debris as the compacted or packed region is reduced in height and the collected debris is removed from the production string to surface.

Conversely, when the fluid is flowing down the string, particles will be prevented from flowing past the apparatus by the closely spaced coils 46 thereby retaining the debris above the apparatus. In addition, it will be appreciated that during no flow conditions through the string, the lack of fluid flow therethrough will permit debris to drop down the string which may also therefor be collected between the coiled member 40 and the inner surface 28.

Figure 5:
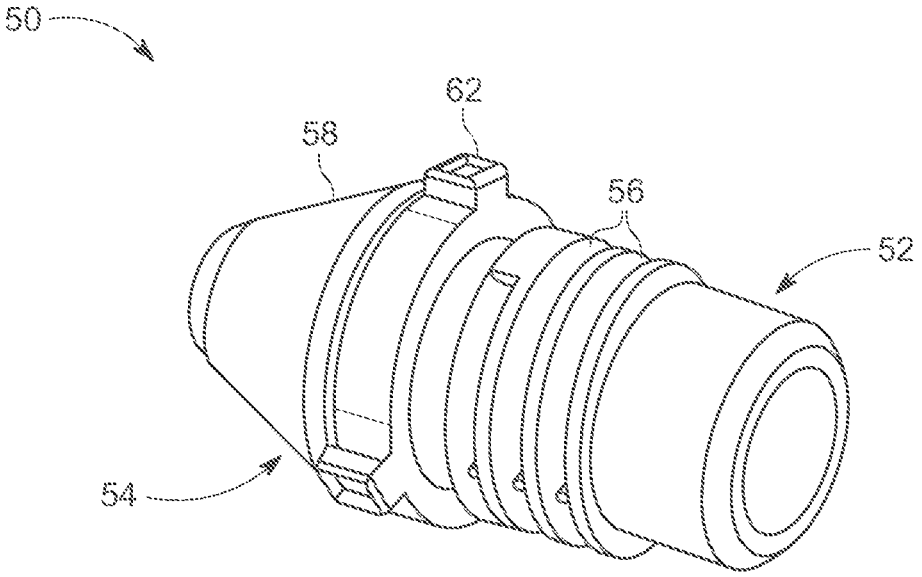
FIG. 5 is a perspective view of the top cap of the apparatus of FIG. 1

Turning now to FIG. 5, the top cap 50 comprises a tubular portion 52 and a top portion 54. The tubular portion 52 is sized to fit within the coiled member 40 and be secured thereto. As illustrated, the tubular portion 52 may include a spiral groove 56 therearound having a shape corresponding to the coiled member so as to receive the coiled member therein. The coiled member 40 may thereafter be secured to the tubular portion 52 by fasteners, adhesives, compression or the like. The top portion 54 may include a domed top 58 to provide a smooth fluid flow therearound although other profiles may be utilized as well. The top portion is sized to be received within the outer tubular member 22 with a top gap distance generally indicated at 60 in FIG. 3. The top portion 54 may also include spacers 62 extending therebetween which are sized and positioned to retain the top cap 50 within the middle of the bore 30. Although a top cap 50 is illustrated and described above, it will be appreciated that other means of enclosing the top end of the coiled member 40 may be utilized such as a solid barrier extending thereacross or by reducing the radius of the coils proximate to the top end to zero to form the end of the coiled member 40 itself into an end cap.

Optionally, as illustrated in FIGS. 3 and 4, the apparatus 20 may include a spacer tube 70 extending between the second end connector 36 and the second end 44 of the coiled member 40. The spacer tube 70 is sized to an outer surface within the inner surface 28 of the outer tubular member 22 so as to form an annular chamber 72 therebetween. In operation, the annular chamber 72 collects and stores any particles collected in the coiled member gap 49 which is thereafter allowed to fall into the annular chamber 72. The length of the spacer tube 70 may be selected to provide the desired storage capacity. The spacer tube 70 may be secured to the second end connector 36 by any known means, including, by way of non-limiting example, fasteners, threading, adhesives, welding or the like. Optionally the spacer tube may be co-formed with the second end cap. The spacer tube 70 may also include radial spacer blocks 74 for cantering the spacer tube within the outer tubular member 22. Optionally as illustrated in FIG. 4, the top connector 28 may include a blocking body 76 located adjacent thereto so as to prevent the top cap 50 from engaging in and sealing against the top connector. As illustrated in FIG. 4, the blocking body 76 may comprise a crossed member extending across the central bore 30 although it will be appreciated that other shapes may also be useful for this purpose.

Figure 6:
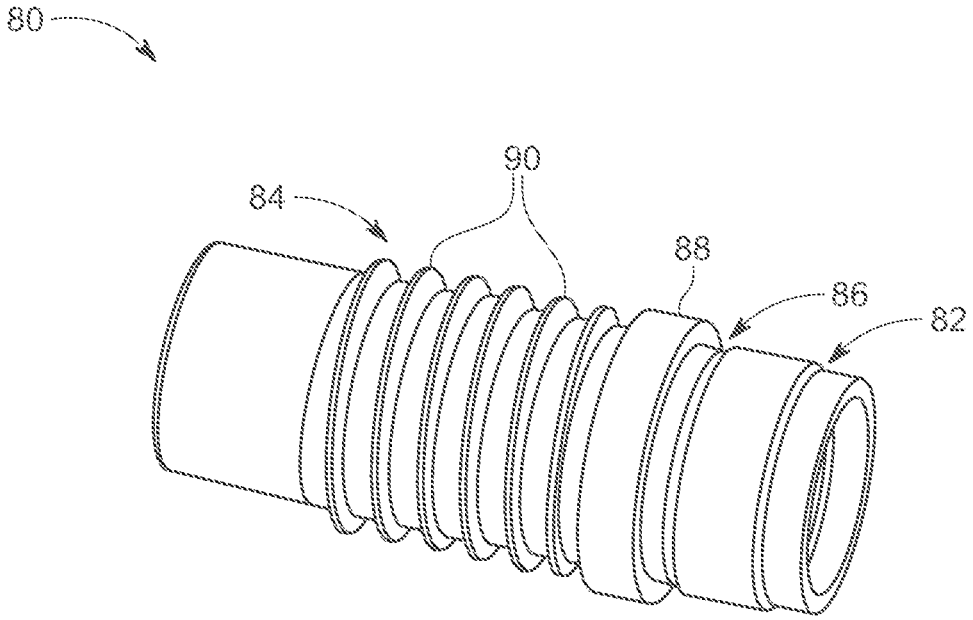
FIG. 6 is a perspective view of the bottom connector of the apparatus of FIG. 1

The spacer tube 70 or the bottom end cap 36 may be connected to the coiled member with a bottom connector 80 as illustrated in FIG. 6. The bottom connector 80 comprises a tube connection portion 82 and a coiled member connection portion 84. The tube connection portion 82 is sized to be received within the spacer tube 70 and may include an annular groove 86 at an upper end thereof. The annular groove 86 is adapted to receive a fastener such as a setscrew (not shown) passing through the spacer tube 70 thereby securing the bottom connector 80 to the spacer tube. It will be appreciated that other connection means may also be utilized. The bottom connector 80 includes an annular ridge 88 extending therearound between the tube connection portion 82 and the coiled member connection portion 84 so as to provide an end surface against which to abut the spacer tube when the bottom connector is inserted thereinto. The coiled member connection portion may include a spiral groove 90 therearound having a shape corresponding to the coiled member so as to receive the coiled member therein. The coiled member 40 may thereafter be secured to the coiled member connection portion 84 by fasteners, adhesives, compression or the like.

While specific embodiments have been described and illustrated, such embodiments should be considered illustrative only and not as limiting the disclosure as construed in accordance with the accompanying claims.

What is claimed is:

1. An apparatus for collecting downhole debris comprising:

a tubular member extending between first and second ends connectable to a downhole production string connectable in fluidic communication with the production string and having an open flow path therethrough between the first and second ends;

at least one coiled member extending between first and second ends, said second end being operably connected to the tubular member, the coiled member having a first configuration with adjacent coils touching each other to allow flow of fluid and prevent flow of particles therethrough and a second configuration with the adjacent coils spaced apart from each other to allow flow of fluid and particles therethrough; and a top end proximate to the first end of the at least one coiled member and adapted to sealably close a top end of the at least one coiled member in the first configuration.

2. The apparatus of claim 1 wherein further including first and second end connectors at each end of the tubular member.

3. The apparatus of claim 2 further comprising a spacing inner tube extending between the second end connector and the second end of the at least one coiled member so as to form an annulus between the inner tube and tubular member.

4. The apparatus of claim 3 wherein the inner tube has a length selected to contain a desired quantity of a debris between the inner tube and the tubular member.

5. The apparatus of claim 1 wherein the at least one coiled member is biased to a compressed first configuration at an initial position.

6. The apparatus of claim 1 wherein the at least one coiled member comprises a spring.

7. The apparatus of claim 6 wherein the spring has a spring rate selected to be expanded by a pressure differential acting on the closed end in response to an upward flow at a predetermined flow rate.

8. The apparatus of claim 1 wherein the closed end comprise a top cap.

9. The apparatus of claim 1 wherein the top cap extends between top and bottom surfaces.

10. The apparatus of claim 9 wherein the bottom surface includes an annular groove therearound for receiving the first end of the at least one coiled member therein.

11. The apparatus of claim 9 wherein the top surface is substantially conical.

12. The apparatus of claim 8 wherein the top cap is annularly spaced apart from an interior surface of the tubular member by a distance corresponding to the distance between the inner tube and the tubular member.

13. The apparatus of claim 1 further comprising locating the apparatus within vertical orientations of a wellbore.

14. The apparatus of claim 1 further comprising locating the apparatus within deviated orientations of a wellbore.

15. The apparatus of claim 1 further comprising locating the apparatus within horizontal orientations of a wellbore.

16. A method for collecting downhole debris comprising:

locating a tubular member extending between first and second ends at a location within a downhole production string, extending at least one coiled member within the tubular member to an open configuration with adjacent coils spaced apart from each other through the tubular member so as to permit upward flow of fluids and solid particles in an upward direction therethrough; and compressing the at least one coiled member to a closed configuration with the adjacent coils touching each other so as to permit fluid flow between coils of the coiled member while preventing passage of solid particles in a downward direction therethrough.

* * * * *